US008427468B2

(12) United States Patent
Hong et al.

(10) Patent No.: US 8,427,468 B2
(45) Date of Patent: Apr. 23, 2013

(54) APPARATUS AND METHOD FOR DRIVING MOBILE DISPLAY DEVICE

(75) Inventors: Hee Jung Hong, Seoul (KR); Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/450,069

(22) Filed: Apr. 18, 2012

(65) Prior Publication Data

US 2012/0262442 A1 Oct. 18, 2012

Related U.S. Application Data

(62) Division of application No. 11/638,024, filed on Dec. 13, 2006, now Pat. No. 8,179,391.

(30) Foreign Application Priority Data

Jan. 25, 2006 (KR) ..... 10-2006-007712

(51) Int. Cl.
*G09G 5/00* (2006.01)
*G09G 3/36* (2006.01)

(52) U.S. Cl.
USPC ..... 345/212; 345/102; 345/207

(58) Field of Classification Search ..... 345/87–102, 345/207, 211–213, 690; 340/7.32, 7.37, 340/223.1; 348/223.1–229.1, 255, 333.13, 348/528; 455/343.1, 343.5, 574; 713/320
See application file for complete search history.

(56) References Cited

U.S. PATENT DOCUMENTS

| | | | |
|---|---|---|---|
| 5,854,617 | A | 12/1998 | Lee et al. |
| 2004/0178743 | A1 | 9/2004 | Miller et al. |
| 2006/0274212 | A1 | 12/2006 | Lo et al. |
| 2006/0284823 | A1 | 12/2006 | Kerofsky et al. |

FOREIGN PATENT DOCUMENTS

| | | |
|---|---|---|
| JP | 62-235883 | 10/1987 |
| JP | 06-205343 | 7/1994 |
| JP | 2004-295086 | 10/2004 |
| JP | 2006201399 A | 8/2006 |

OTHER PUBLICATIONS

Office Action issued in corresponding Japanese Patent Application No. 2006-338906; issued Apr. 20, 2010.

*Primary Examiner* — Rodney Amadiz
(74) *Attorney, Agent, or Firm* — Brinks Hofer Gilson & Lione

(57) ABSTRACT

A mobile display device driving apparatus and method which can reduce power consumption are disclosed. The driving apparatus includes a liquid crystal panel a battery, a power saving mode signal generator that detects the remaining power of the battery and generates a power saving mode signal based on the detected power to set a power saving mode of the liquid crystal panel. A controller sets a gain value in response to the power saving mode signal, converts external three-color input data into four-color data based on the set gain value and generates a dimming signal in response to the power saving mode signal. A panel driver displays an image based on the four-color data. An inverter generates a lamp drive voltage based on the dimming signal, and a backlight unit generates light in response to the lamp drive voltage and irradiates the generated light to the liquid crystal panel.

22 Claims, 9 Drawing Sheets

APPARATUS AND METHOD FOR DRIVING MOBILE DISPLAY DEVICE

The present patent document is a divisional of U.S. patent application Ser. No. 11/638,024, filed Dec. 13, 2006, now U.S. Pat. No. 8,179,391 which claims priority to Korean Patent Application No. P2006-007712 filed in Korea on Jan. 25, 2006, which are hereby incorporated by reference.

BACKGROUND

1. Field of the Invention

The present invention relates to a mobile display device, and more particularly, to a mobile display device driving apparatus and method that can reduce power consumption.

2. Discussion of the Related Art

The communication scheme of mobile display devices has gradually changed from voice communication to video communication with the rapid development of technologies thereof.

Generally, the mobile display devices may include mobile terminals including a mobile communication terminal, a personal communication service (PCS) terminal, a personal digital assistant (PDA), a smart phone and a next-generation mobile communication (IMT-2000) terminal, a notebook personal computer (PC), a navigation terminal, a portable game machine, or other mobile devices.

The mobile terminals, among the mobile display devices, generally employ liquid crystal display (LCD) devices to provide information regarding the operations of the terminals, including voice calls. Such an LCD device is adapted to display an image by adjusting transmittance of light irradiated from a backlight unit. This LCD device is used for a wider range of applications with the trend of multimedia, and the display scheme thereof has been advanced from black and white display to color display.

However, because such a mobile terminal is able to not only perform a voice call, but also reproduce a color image, the mobile terminal consumes a large amount of power, thereby exhausting a battery within a short period of time.

In addition, a notebook PC, navigation terminal or portable game machine may also use an LCD device to display a color image, so that it may consume a large amount of power, thus exhausting a battery within a short period of time.

BRIEF SUMMARY

Accordingly, an apparatus and method is disclosed for driving a mobile display device that substantially obviate one or more problems due to limitations and disadvantages of the related art.

An apparatus for driving a mobile display device includes a liquid crystal panel with a plurality of liquid crystal cells each formed in sub-pixel areas of four colors. The apparatus includes a battery charged with a voltage, a power saving mode signal generator that detects a remaining power of the battery and generates a power saving mode signal based on the detected power to set a power saving mode of the liquid crystal panel. The apparatus includes a controller that sets a gain value in response to the power saving mode signal, converting external three-color input data into four-color data according to the set gain value and generating a dimming signal in response to the power saving mode signal. A panel driver displays an image corresponding to the four-color data on the liquid crystal panel. An inverter generates a lamp drive voltage in response to the dimming signal, and a backlight unit generates light in response to the lamp drive voltage and irradiates the generated light to the liquid crystal panel.

An apparatus for driving a mobile display device is also disclosed, including a liquid crystal panel with a plurality of liquid crystal cells each formed in sub-pixel areas of four colors. The apparatus also includes an optical sensor that detects the amount of ambient light and a power saving mode signal generator that generates a power saving mode signal based on the ambient light amount detected by the optical sensor to set a power saving mode of the liquid crystal panel. A controller sets a gain value in response to the power saving mode signal, converting external three-color input data into four-color data according to the set gain value and generating a dimming signal in response to the power saving mode signal. A panel driver displays an image corresponding to the four-color data on the liquid crystal panel. An inverter generates a lamp drive voltage in response to the dimming signal, and a backlight unit generates light in response to the lamp drive voltage and irradiates the generated light to the liquid crystal panel.

A method is disclosed for driving a mobile display device, where the display device includes a liquid crystal panel having a plurality of liquid crystal cells each formed in sub-pixel areas of four colors. The method includes detecting a remaining power of a battery charged with a voltage and generating a power saving mode signal based on the detected power to set a power saving mode of the liquid crystal panel; setting a gain value in response to the power saving mode signal, converting external three-color input data into four-color data according to the set gain value and generating a dimming signal in response to the power saving mode signal; driving a backlight unit in response to a lamp drive voltage corresponding to the dimming signal to irradiate light to the liquid crystal panel; and supplying image signals corresponding to the four-color data to the liquid crystal panel to display a corresponding image on the liquid crystal panel.

A method for driving a mobile display device is also disclosed, where the display device includes a liquid crystal panel having a plurality of liquid crystal cells each formed in sub-pixel areas of four colors. The method includes detecting the amount of ambient light and generating a power saving mode signal based on the detected ambient light amount to set a power saving mode of the liquid crystal panel; setting a gain value in response to the power saving mode signal, converting external three-color input data into four-color data according to the set gain value and generating a dimming signal in response to the power saving mode signal; driving a backlight unit in response to a lamp drive voltage corresponding to the dimming signal to irradiate light to the liquid crystal panel; and supplying image signals corresponding to the four-color data to the liquid crystal panel to display a corresponding image on the liquid crystal panel.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like referenced numerals designate corresponding parts throughout the different views.

DETAILED DESCRIPTION OF THE DRAWINGS AND THE PRESENTLY PREFERRED EMBODIMENTS

Figure 1:
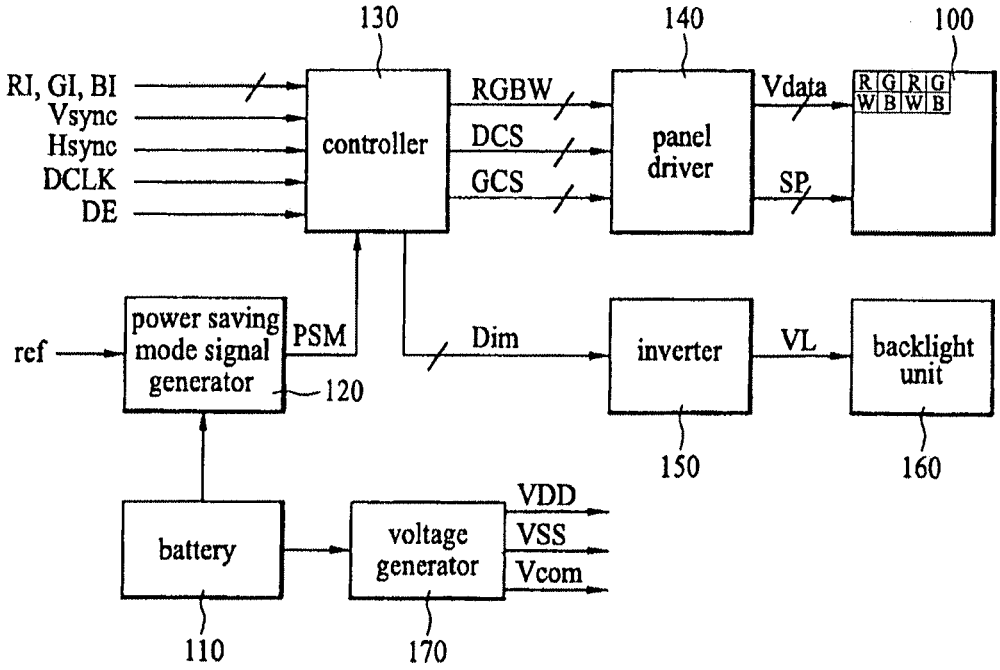
FIG. 1 is a block diagram schematically showing the configuration of an apparatus that drives a mobile display device.

FIG. 1 is a block diagram schematically showing the configuration of an apparatus that drives a mobile display device.

FIG. 1 illustrates an example mobile display device driving apparatus. The mobile display device comprises a liquid crystal panel 100 having a plurality of liquid crystal cells each formed in sub-pixel areas of four colors and displaying an image by adjusting light transmittance of the liquid crystal cells, a battery 110 charged with a voltage, a power saving mode signal generator 120 that detects the remaining power of the battery 110 and generates a power saving mode signal PSM based on the detected power to set a power saving mode of the liquid crystal panel 100, a controller 130 that sets a gain value in response to the power saving mode signal PSM, converts external three-color input data RI, GI and BI into four-color data RGBW according to the set gain value and generates a dimming signal Dim in response to the power saving mode signal PSM, a panel driver 140 that displays an image corresponding to the four-color data RGBW from the controller 130 on the liquid crystal panel 100, an inverter 150 that generates a lamp drive voltage VL in response to the dimming signal Dim from the controller 130, a backlight unit 160 that generates light in response to the lamp drive voltage VL from the inverter 150 and irradiates the generated light to the liquid crystal panel 100, and a voltage generator 170 that generates various voltages necessary for the driving of the mobile display device using the voltage charged in the battery 110.

The liquid crystal panel 100 includes a plurality of thin film transistors formed respectively in areas defined by a plurality of gate lines and a plurality of data lines, not shown, and a plurality of liquid crystal cells connected respectively to the thin film transistors. Each thin film transistor supplies an image signal Vdata from an associated one of the data lines to an associated one of the liquid crystal cells in response to a scan pulse SP from an associated one of the gate lines. Each liquid crystal cell can be equivalently expressed as a liquid crystal capacitor because it is provided with a common electrode facing via a liquid crystal, and sub-pixel electrodes connected to the associated thin film transistor. This liquid crystal cell includes a storage capacitor that maintains an image signal charged on the liquid crystal capacitor until the next image signal is charged thereon.

This liquid crystal panel 100 includes red (R), green (G), blue (B) and white (W) sub-pixels arranged in matrix form. No separate color filter is disposed in the W sub-pixel, whereas color filters corresponding to respective colors are formed in the R, G and B sub-pixels, respectively. The R, G, B and W sub-pixels have a stripe structure or quad structure of the same or different area ratios.

The battery 110 is charged with a certain amount of voltage required to drive the mobile display device for a lengthy period of time. When the charged voltage is exhausted due to the long driving of the mobile display device, the battery 110 is re-charged by the user.

The voltage generator 170 generates various voltages (for example, VDD, VSS, Vcom, etc.) necessary for the driving of the mobile display device using the voltage charged in the battery 110.

Figure 2:
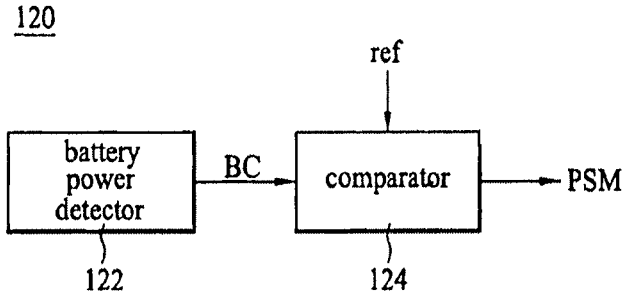
FIG. 2 is a schematic block diagram of a power saving mode signal generator in FIG. 1.

The power saving mode signal generator 120 includes a battery power detector 122 and a comparator 124, as shown in FIG. 2.

The battery power detector 122 detects the voltage charged in the battery 110 and supplies a detect signal BC based on the remaining power of the battery 110 to the comparator 124.

The comparator 124 acts to compare the detect signal BC from the battery power detector 122 with a reference signal ref and generate the power saving mode signal PSM as a result of the comparison, when the mobile display device is set to the power saving mode by the user. At this time, the power saving mode signal PSM assumes a high state when the detect signal BC is higher than or equal to the reference signal ref and a low state when the detect signal BC is lower than the reference signal ref. The reference signal ref may have a level corresponding to 30% of the total capacity of the battery 110.

Figure 3:
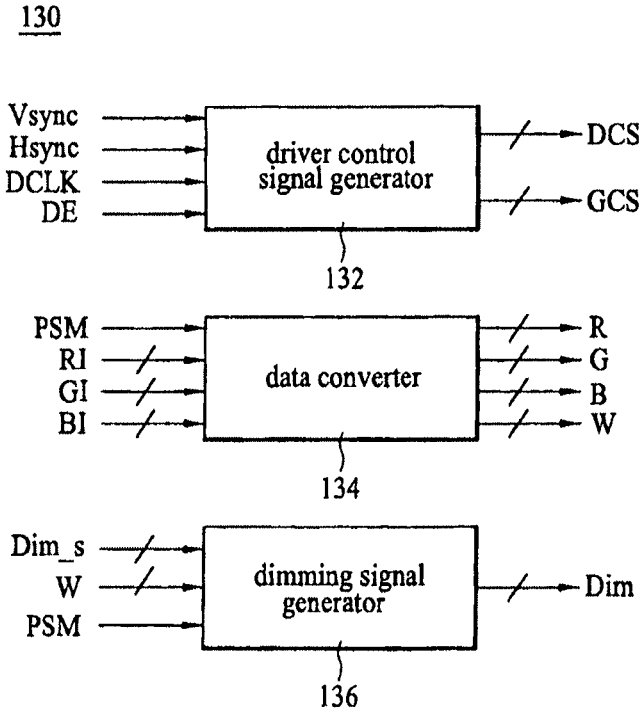
FIG. 3 is a schematic block diagram of a controller in FIG. 1.

In FIG. 1, the controller 130 includes, as shown in FIG. 3, a driver control signal generator 132, data converter 134, and dimming signal generator 136.

The driver control signal generator 132 generates data and gate control signals DCS and GCS for control of the panel driver 140 using an external input clock signal DCLK, a data enable signal DE and vertical and horizontal synchronous signals Vsync and Hsync.

Figure 4:
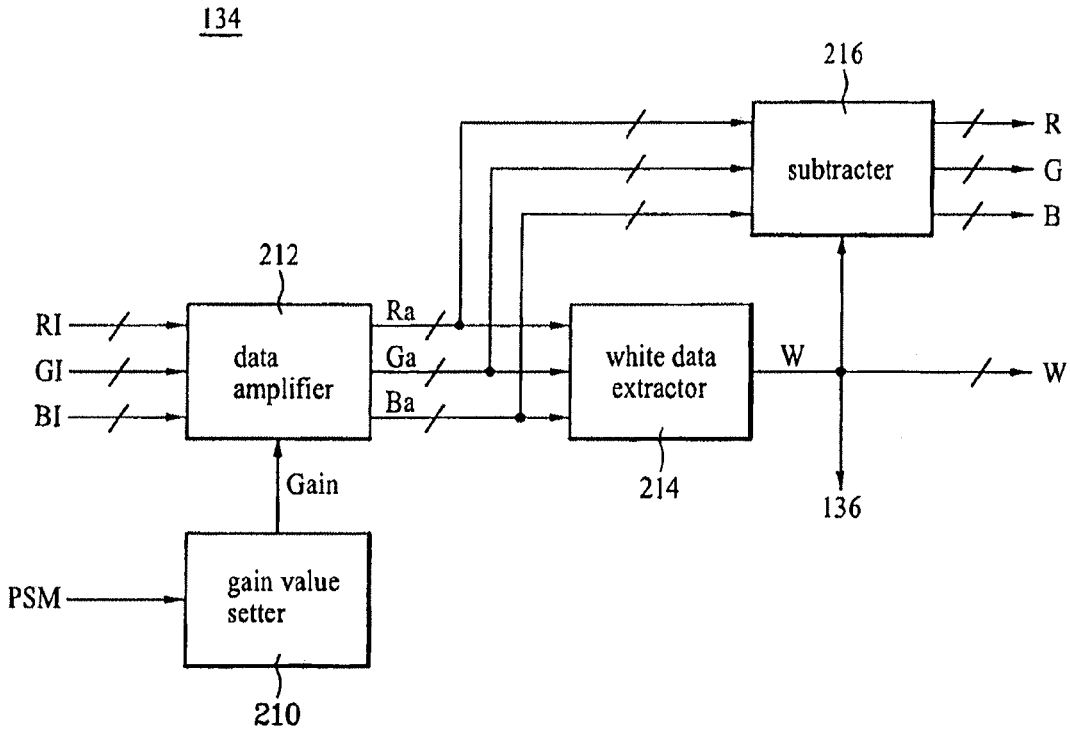
FIG. 4 is a block diagram of a data converter in FIG. 3.

FIG. 4 is a block diagram showing a first embodiment of the data converter 134 in FIG. 3. In FIG. 4, in association with FIG. 1, the data converter 134 includes a gain value setter 210, a data amplifier 212, a white data extractor 214, and a subtracter 216.

The gain value setter 210 functions to set a gain value "Gain" based on the power saving mode signal PSM from the power saving mode signal generator 120 and supply the set gain value "Gain" to the data amplifier 212.

When the power saving mode signal PSM assumes the high state, the gain value setter 210 sets the gain value "Gain" to the range of about "1≦"Gain"<2" and supplies the set gain value "Gain" to the data amplifier 212. Conversely, when the power saving mode signal PSM assumes the low state, the gain value setter 210 sets the gain value "Gain" to a maximum value or a rational number greater than or equal to about two and supplies the set gain value "Gain" to the data amplifier 212.

The data amplifier 212 multiplies each of the external three-color input data RI, GI and BI by the gain value "Gain" from the gain value setter 210 to generate three-color amplified data Ra, Ga and Ba, as in the following equation 1.

$$Ra=RI\times\text{Gain}$$

$$Ga=GI\times\text{Gain}$$

$$Ba=BI\times\text{Gain} \qquad \text{Equation 1}$$

The white data extractor 214 extracts white data W from the three-color amplified data Ra, Ga and Ba input from the data amplifier 212 and supplies the extracted white data W to the subtracter 216, panel driver 140 and dimming signal generator 136. Preferably, the white data W is a common component of the three-color amplified data Ra, Ga and Ba, namely, a minimum one of respective gray scale levels of the red data Ra, green data Ga and blue data Ba. Alternatively, the white data W may be a difference between a maximum one and minimum one of the respective gray scale levels of the red data Ra, green data Ga and blue data Ba, or an average thereof.

The subtracter 216 subtracts the white data W supplied from the white data extractor 214 from each of the three-color amplified data Ra, Ga and Ba input from the data amplifier 212 to generate three-color data RGB of the four-color data RGBW, as in the following equation 2:

$$R=Ra-W$$

$$G=Ga-W$$

$$B=Ba-W \qquad \text{Equation 2}$$

In this manner, the data converter 134 according to the first embodiment generates the three-color data RGB by amplifying the three-color input data RI, GI and BI by the gain value "Gain" set in response to the power saving mode signal PSM, extracting the white data W from the three-color amplified data Ra, Ga and Ba and subtracting the white data W from the three-color amplified data Ra, Ga and Ba. Then, the data converter 134 supplies the white data W extracted by the white data extractor 214 and the three-color data RGB outputted from the subtracter 216 as the four-color data RGBW to the panel driver 140.

Figure 5:
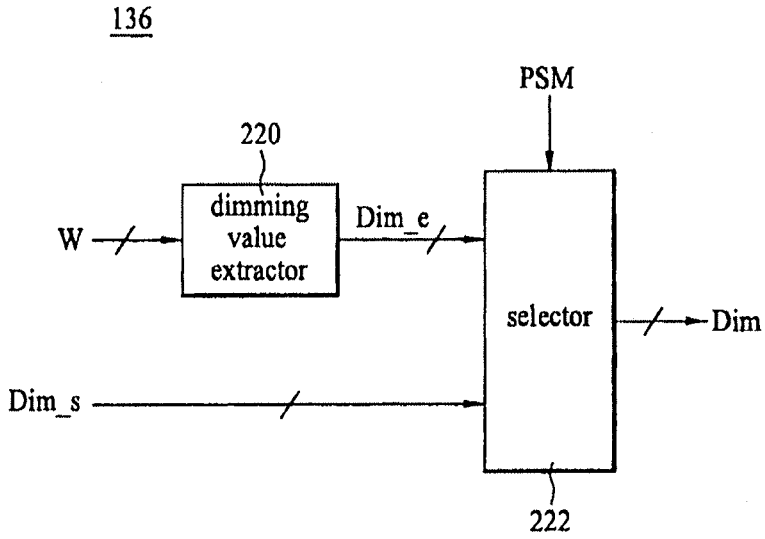
FIG. 5 is a schematic block diagram of a dimming signal generator in FIG. 3.

In FIG. 3, the dimming signal generator 136 includes a dimming value extractor 220 and a selector 222, as shown in FIG. 5.

Figure 6:
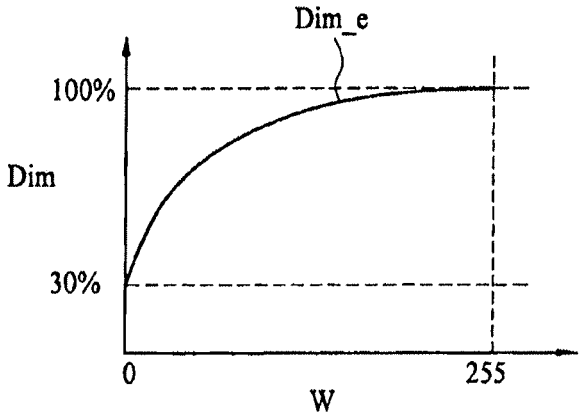
FIG. 6 is a graph showing an example dimming curve for extraction of a first dimming value in a dimming value extractor in FIG. 5.

The dimming value extractor 220 extracts a first dimming value signal Dim_e corresponding to the white data W from a dimming curve which has a linear curve shape set between a dimming value (30%) corresponding to the minimum gray scale level and a dimming value (100%) corresponding to the maximum gray scale level, as shown in FIG. 6, and supplies the extracted first dimming value Dim_e to the selector 222.

The selector 222 selects any one of the first dimming value signal Dim_e extracted by the dimming value extractor 220 and a second dimming value signal Dim_s set by the user in response to the power saving mode signal PSM and supplies the selected dimming value to the inverter 150. At this time, the second dimming value signal Dim_s may be fixed or arbitrarily set by the user to reduce power consumption of the backlight unit 170. The second dimming value signal Dim_s is set to about 67%. That is, even though a dimming value is set to 67%, the four-color sub-pixel (RGBW) structure of the liquid crystal panel 100 exhibits the same brightness as that of a three-color sub-pixel (RGB) structure, since the original brightness of the four-color sub-pixel (RGBW) structure is about 1.5 times as high as that of the three-color sub-pixel (RGB) structure.

When the power saving mode signal PSM assumes the high state, the selector 222 selects the first dimming value signal Dim_e extracted by the dimming value extractor 220 as the dimming signal Dim and supplies the selected first dimming value signal Dim_e to the inverter 150. Conversely, when the power saving mode signal PSM assumes the low state, the selector 222 selects the set second dimming value signal Dim_s as the dimming signal Dim and supplies the selected second dimming value signal Dim_s to the inverter 150.

Figure 7A:
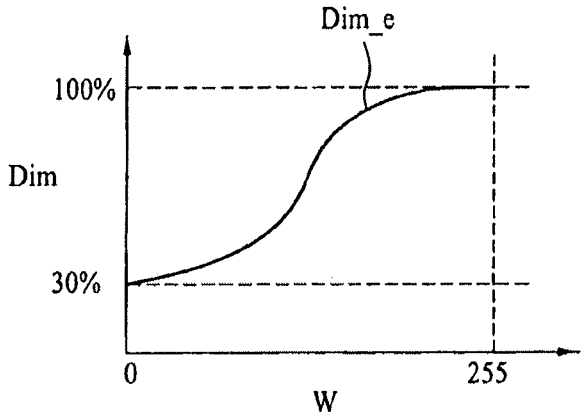
FIG. 7*a* is a graph showing a second example dimming curve for the extraction of the first dimming value in the dimming value extractor in FIG. 5.
Figure 7B:
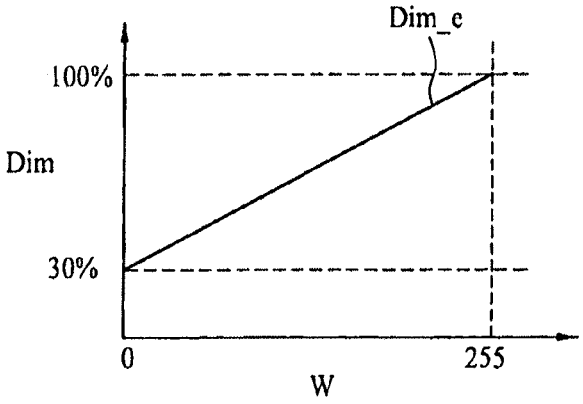
FIG. 7*b* is a graph showing another example dimming curve for the extraction of the first dimming value in the dimming value extractor in FIG. 5.

Alternatively, the dimming curve for the extraction of the first dimming value signal Dim_e in the dimming value extractor 220 may have a quadratic curve shape set between the dimming value (30%) corresponding to the minimum gray scale level and the dimming value (100%) corresponding to the maximum gray scale level, as shown in FIG. 7*a*, or a diagonal shape set between the dimming value (30%) corresponding to the minimum gray scale level and the dimming value (100%) corresponding to the maximum gray scale level, as shown in FIG. 7*b*.

In FIG. 1, the panel driver 140 includes a data driver (not shown) responsive to the data control signal DCS from the controller 130 that converts each of the four-color data RGBW from the controller 130 into an image signal Vdata and supplies the converted image signal Vdata to an associated data line of the liquid crystal panel 100, and a gate driver (not shown) responsive to the gate control signal GCS from the controller 130 that supplies a scan pulse SP to each gate line of the liquid crystal panel 100.

The inverter 150 generates the lamp drive voltage VL in response to the dimming signal Dim from the controller 130 and supplies it to the backlight unit 160. At this time, at least one of the level and width of the drive voltage VL is adjusted with the dimming signal Dim.

The backlight unit 160 generates light in response to the lamp drive voltage VL from the inverter 150 and irradiates the generated light to the rear surface of the liquid crystal panel 100. Preferably, the backlight unit 160 includes a lamp or a plurality of light emitting diodes.

The power saving mode signal PSM is set depending on the remaining power of the battery 110. When the remaining power of the battery 110 is greater than or equal to about the level of the reference signal ref, three-color input data RGB is converted into four-color data RGBW using a gain value "Gain" set to the range of about 1 to 2 and a dimming signal Dim corresponding to the white data W of the four-color data RGBW is generated. As a result, the liquid crystal panel 100 displays a color image by adjusting transmittance of light, irradiated from the backlight unit 160 depending on the dimming signal Dim, according to image signals Vdata corresponding to the four-color data RGBW.

Conversely, when the remaining power of the battery 110 is smaller than the level of the reference signal ref, three-color input data RGB is converted into four-color data RGBW using a maximum gain value Gain set to a rational number greater than or equal to about two and a dimming signal Dim set to reduce power consumption of the backlight unit 160 is generated. As a result, the liquid crystal panel 100 displays a color image using image signals Vdata corresponding to the four-color data RGBW and light irradiated from the backlight unit 160 depending on the dimming signal Dim.

Therefore, the mobile display device driving apparatus and method can adjust the gain value "Gain" and a dimming signal Dim according to the power saving mode signal PSM based on the remaining power of the battery 110 to reduce power consumption of the backlight unit 160, so as to increase the usable time of the battery 110.

Figure 8:
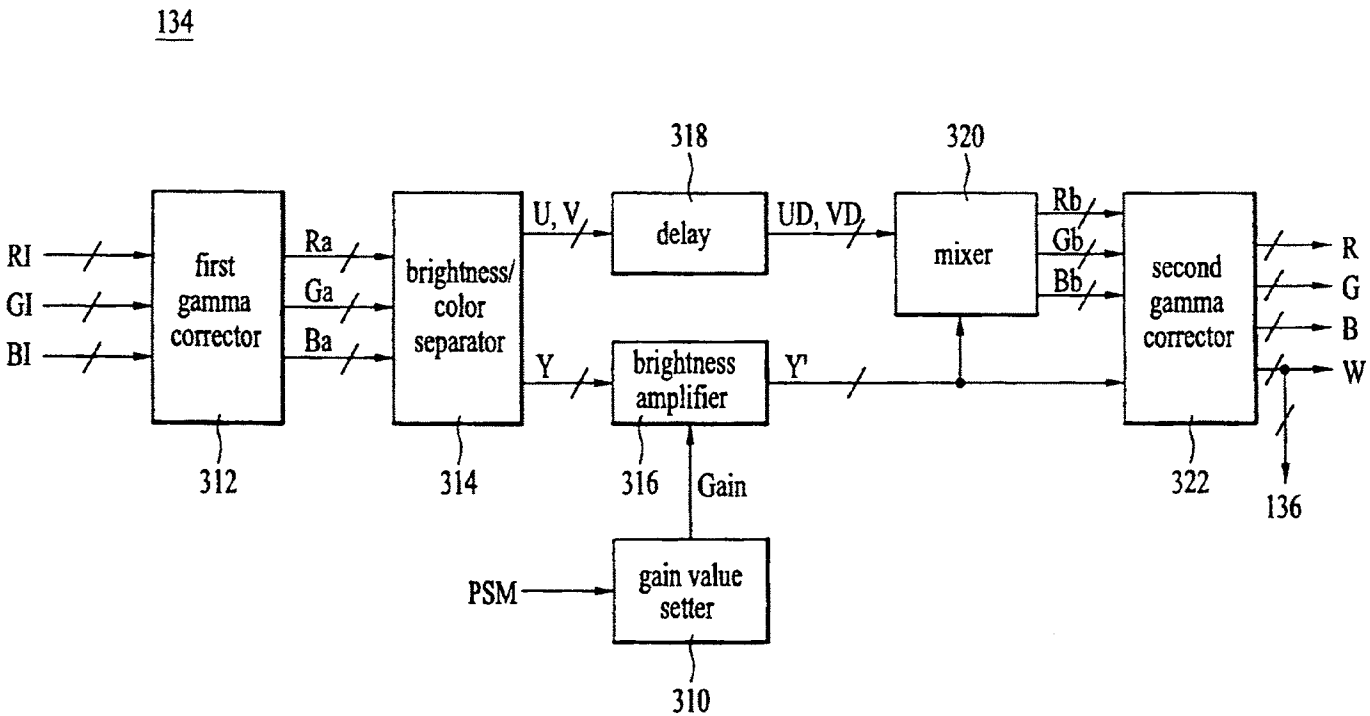
FIG. 8 is a block diagram showing an example data converter in FIG. 3.

FIG. 8 is a block diagram showing a second embodiment of the data converter 134 in FIG. 3. In FIG. 8 in association with FIG. 1, the data converter 134 is adapted to generate the four-color data RGBW using a brightness component of the three-color input data RI, GI and BI and selectively output the three-color data RGB of the four-color data RGBW, except for the white data W, in response to the power saving mode signal PSM such that a color image or black and white image is displayed on the liquid crystal panel 100.

In one system, the data converter 134 includes a gain value setter 310, first gamma corrector 312, brightness/color separator 314, brightness amplifier 316, delay 318, mixer 320, and second gamma corrector 322.

The gain value setter 310 functions to set a gain value "Gain" based on the power saving mode signal PSM from the power saving mode signal generator 120 and to supply the set gain value Gain value to the brightness amplifier 316.

When the power saving mode signal PSM assumes the high state, the gain value setter 310 sets the gain value Gain value to the range of about "1≦"Gain"<2" and supplies the set gain value "Gain" to the brightness amplifier 316. Conversely, when the power saving mode signal PSM assumes the low state, the gain value setter 310 sets the gain value "Gain" to a maximum value or a rational number greater than or equal to about two and supplies the set gain value "Gain" to the brightness amplifier 316.

The first gamma corrector 312 inverse gamma corrects the three-color input data RI, GI and BI into linearized primary three-color data Ra, Ga and Ba, as in an equation 3 below. It should be noted here that the three-color input data RI, GI and BI are signals already gamma corrected in consideration of output characteristics of a cathode ray tube.

$$Ra=RI^{\gamma}$$

$$Ga=GI^{\gamma}$$

$$Ba=BI^{\gamma} \qquad \text{Equation 3}$$

The brightness/color separator 314 separates the primary three-color data Ra, Ga and Ba into a brightness component Y and color components U and V. The brightness/color separator 314 then supplies the brightness component Y separated from the primary three-color data Ra, Ga and Ba to the brightness amplifier 316 and the color components U and V separated from the primary three-color data Ra, Ga and Ba to the delay 318, respectively.

The brightness amplifier 316 multiplies the brightness component Y input from the brightness/color separator 314 by the gain value Gain from the gain value setter 310 to generate an amplified brightness component Y'.

The delay 318 delays the color components U and V while the brightness amplifier 316 generates the amplified brightness component Y', and supplies the delayed color components UD and VD to the mixer 320.

The mixer 320 mixes the delayed color components UD and VD from the delay 318 and the amplified brightness component Y' from the brightness amplifier 316 to generate secondary three-color data Rb, Gb and Bb.

The second gamma corrector 322 gamma corrects the secondary three-color data Rb, Gb and Bb from the mixer 320 and the amplified brightness component Y' from the brightness amplifier 316 to generate the four-color data RGBW, as in the following equation 4:

$$R=(Rb)^{1/\gamma}$$

$$G=(Gb)^{1/\gamma}$$

$$B=(Bb)^{1/\gamma}$$

$$W=(Y')^{1/\gamma} \qquad \text{Equation 4}$$

In this manner, the data converter 134 generates the amplified brightness component Y' by inverse gamma correcting the three-color input data RI, GI and BI into the primary three-color data Ra, Ga and Ba, separating the primary three-color data Ra, Ga and Ba into the brightness component Y and the color components U and V and amplifying the separated brightness component Y by the gain value Gain set in response to the power saving mode signal PSM. Then, the data converter 134 mixes the amplified brightness component Y' and the delayed color components UD and VD to generate the secondary three-color data Rb, Gb and Bb, and gamma corrects the secondary three-color data Rb, Gb and Bb and the amplified brightness component Y' to generate the four-color data RGBW.

Figure 9:
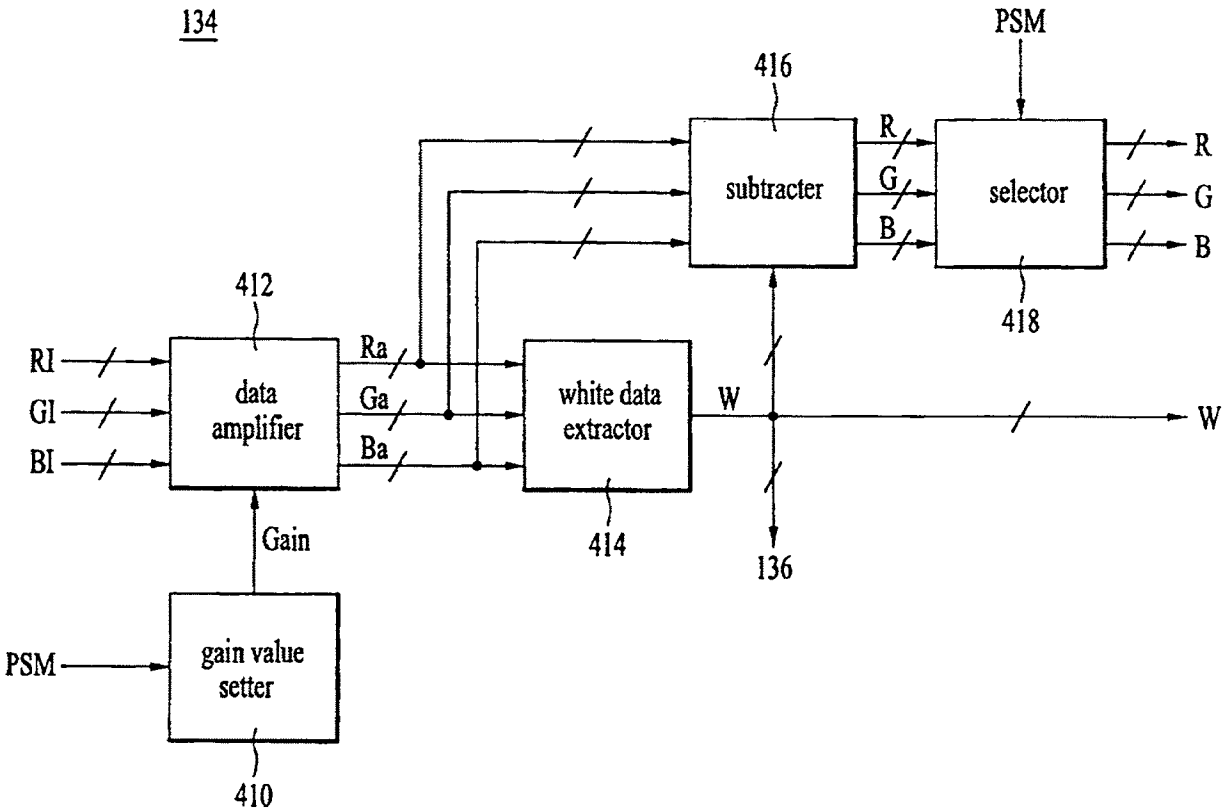
FIG. 9 is a block diagram showing another example data converter in FIG. 3.

FIG. 9 is a block diagram showing an example data converter 134 in FIG. 3. In FIG. 9 in association with FIG. 1, the data converter 134 in one system is adapted to selectively output the three-color data RGB of the four-color data RGBW, except for the white data W, in response to the power saving mode signal PSM such that a color image or black and white image is displayed on the liquid crystal panel 100.

To this end, the data converter 134 according to this third embodiment includes a gain value setter 410, data amplifier 412, white data extractor 414, subtracter 416, and selector 418.

The gain value setter 410 acts to set a gain value Gain value in response to the power saving mode signal PSM from the power saving mode signal generator 120 and supply the set gain value Gain value to the data amplifier 412.

In detail, when the power saving mode signal PSM assumes the high state, the gain value setter 410 sets the gain value "Gain" to the range of about "1≦"Gain"<2" and supplies the set gain value Gain to the data amplifier 412. Conversely, when the power saving mode signal PSM assumes the low state, the gain value setter 410 sets the gain value "Gain" to a maximum value or a rational number greater than or equal to about two and supplies the set gain value Gain to the data amplifier 412.

The data amplifier 412 multiplies the three-color input data RI, GI and BI by the gain value "Gain" set by the gain value setter 410 to generate three-color amplified data Ra, Ga and Ba, as in the aforementioned equation 1.

The white data extractor 414 extracts white data W from the three-color amplified data Ra, Ga and Ba input from the data amplifier 412 and supplies the extracted white data W to the subtracter 416, panel driver 140 and dimming signal generator 136. At this time, the white data W is a common component of the three-color amplified data Ra, Ga and Ba, namely, a minimum one of respective gray scale levels of the red data Ra, green data Ga and blue data Ba. Alternatively, the white data W may be a difference between a maximum one and minimum one of the respective gray scale levels of the red data Ra, green data Ga and blue data Ba, or an average thereof.

The subtracter 416 subtracts the white data W supplied from the white data extractor 414 from each of the three-color amplified data Ra, Ga and Ba inputted from the data amplifier 412 to generate three-color data RGB of the four-color data RGBW, as in the aforementioned equation 2.

The selector 418 selectively supplies the three-color data RGB from the subtracter 416 to the panel driver 140 in response to the power saving mode signal PSM.

When the power saving mode signal PSM assumes the high state, the selector 418 supplies the three-color data RGB to the panel driver 140. As a result, the three-color data RGB from the selector 418 and the white data W from the white data extractor 414 are supplied to the panel driver 140.

Conversely, when the power saving mode signal PSM assumes the low state, the selector 418 does not supply the three-color data RGB to the panel driver 140. As a result, only the white data W from the white data extractor 414 is supplied to the panel driver 140.

The data converter 134 supplies only the white data W of the four-color data RGBW to the panel driver 140 in response to the power saving mode signal PSM of the low state such that a black and white image is displayed on the liquid crystal panel 100, while supplying the four-color data RGBW of the three-color data RGB and white data W to the panel driver 140 based on the power saving mode signal PSM of the high state such that a color image is displayed on the liquid crystal panel 100.

A description will hereinafter be given of a mobile display device driving method using the mobile display device driving apparatus. First, the power saving mode signal PSM of the high state or low state is generated by comparing a remaining power of the battery 110 with the level of the reference signal "ref."

When the remaining power of the battery 110 is greater than or equal to the level of the reference signal "ref," three-color input data RI, GI and BI is amplified using a gain value "Gain" set to the range of about 1 to 2 and white data W is extracted from the three-color amplified data Ra, Ga and Ba. Also, three-color data RGB is generated by subtracting the extracted white data W from the three-color amplified data Ra, Ga and Ba, and a dimming signal Dim corresponding to the white data W is generated. Then, the three-color data RGB is selected depending on the power saving mode signal PSM of the high state, and the selected three-color data RGB and the extracted white data W are supplied to the liquid crystal panel 100 through the panel driver 140.

As a result, the liquid crystal panel 100 displays a color image by adjusting transmittance of light, irradiated from the backlight unit 160 depending on the dimming signal Dim, according to image signals Vdata corresponding to the four-color data RGBW.

Conversely, when the remaining power of the battery 110 is smaller than the level of the reference signal "ref," three-color input data RI, GI and BI is amplified using a maximum gain value "Gain" and white data W is extracted from the three-color amplified data Ra, Ga and Ba. Also, only the extracted white data W is supplied to the panel driver 140 and a dimming signal Dim set to reduce power consumption of the backlight unit 160 is generated. As a result, the liquid crystal panel 100 displays a black and white image using a white image signal Vdata corresponding to the white data W and light irradiated from the backlight unit 160 depending on the dimming signal Dim. At this time, the three-color sub-pixels RGB are turned off or supplied with a black signal.

Therefore, the mobile display device driving apparatus and method can change the display mode of the mobile display device to a color display mode or black and white display mode depending on the remaining power of the battery and reduce the dimming value of the backlight unit in the black and white display mode, so as to increase the usable time of the battery.

Figure 10:
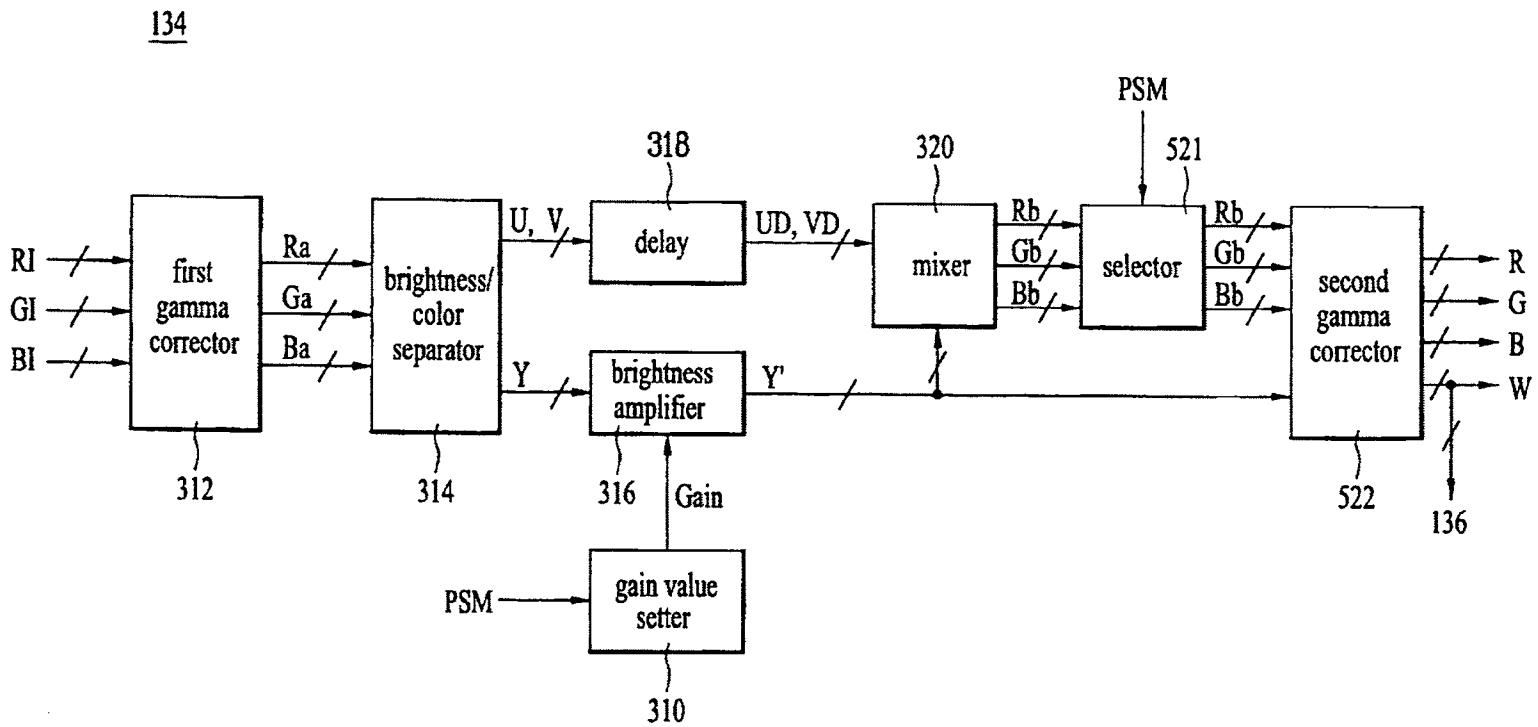
FIG. 10 is a block diagram showing an example data converter in FIG. 3.

FIG. 10 is a block diagram showing an example data converter 134 in FIG. 3. In FIG. 10 in association with FIG. 1, the data converter 134 is adapted to generate the four-color data RGBW using a brightness component of the three-color input data RI, GI and BI and selectively output the three-color data RGB of the four-color data RGBW, except for the white data W, in response to the power saving mode signal PSM such that a color image or black and white image is displayed on the liquid crystal panel 100.

To this end, the data converter 134 includes a gain value setter 310, a first gamma corrector 312, a brightness/color separator 314, a brightness amplifier 316, a delay 318, a mixer 320, a selector 521, and a second gamma corrector 522.

The gain value setter 310, the first gamma corrector 312, the brightness/color separator 314, the brightness amplifier 316, the delay 318 and the mixer 320 in the data converter 134 are the same in configuration and operation as those in the data converter 134 shown in FIG. 8, and a description thereof will thus be omitted.

The selector 521 acts to selectively supply the secondary three-color data Rb, Gb and Bb from the mixer 320 to the second gamma corrector 522 based on the power saving mode signal PSM.

When the power saving mode signal PSM assumes the high state, the selector 521 supplies the secondary three-color data Rb, Gb and Bb to the second gamma corrector 522. As a result, supplied to the second gamma corrector 522 are the secondary three-color data Rb, Gb and Bb from the selector 521 and the amplified brightness component Y' from the brightness amplifier 316.

Conversely, when the power saving mode signal PSM assumes the low state, the selector 521 does not supply the secondary three-color data Rb, Gb and Bb to the second gamma corrector 522. As a result, only the amplified brightness component Y' from the brightness amplifier 316 is supplied to the second gamma corrector 522.

The second gamma corrector 522 gamma corrects the secondary three-color data Rb, Gb and Bb from the selector 521 and the amplified brightness component Y' from the brightness amplifier 316 to generate the four-color data RGBW, as in the aforementioned equation 4.

The data converter 134 generates the amplified brightness component Y' by inverse-gamma correcting the three-color input data RI, GI and BI into the primary three-color data Ra, Ga and Ba, separating the primary three-color data Ra, Ga and Ba into the brightness component Y and the color components U and V and amplifying the separated brightness component Y by the gain value Gain. Then, the data converter 134 mixes the amplified brightness component Y' and the delayed color components UD and VD to generate the secondary three-color data Rb, Gb and Bb, and gamma corrects the secondary three-color data Rb, Gb and Bb selectively in response to the power saving mode signal PSM and the amplified brightness component Y' directly to generate the four-color data RGBW.

Figure 11:
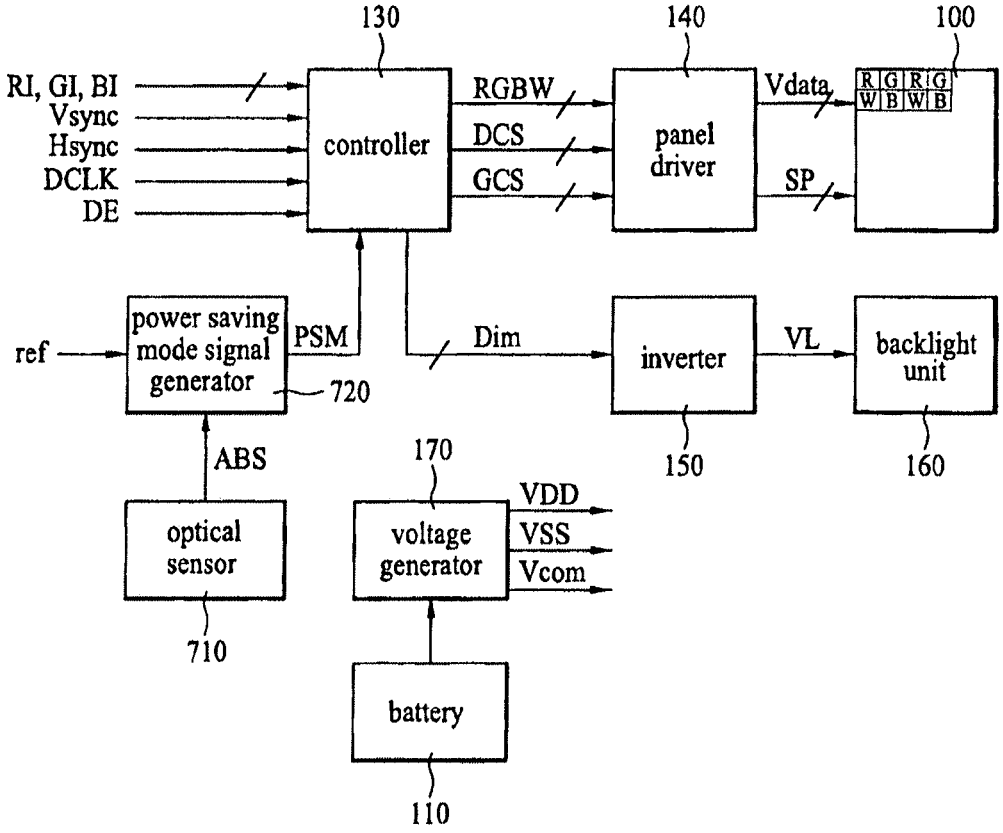
FIG. 11 is a block diagram schematically showing the configuration of an apparatus that drives a mobile display device.

FIG. 11 is a block diagram schematically showing the configuration of an example apparatus for driving a mobile display device. In FIG. 11, the mobile display device driving apparatus comprises a liquid crystal panel 100 having a plurality of liquid crystal cells each formed in sub-pixel areas of four colors and acting to display an image by adjusting light transmittance of the liquid crystal cells, a battery 110 charged with a voltage, an optical sensor 710 that detects the amount of ambient light ABS, a power saving mode signal generator 720 that generates a power saving mode signal PSM based on the ambient light amount ABS detected by the optical sensor 710 to set a power saving mode of the liquid crystal panel 100, a controller 130 that sets a gain value in response to the power saving mode signal PSM, converting external three-color input data RI, GI and BI into four-color data RGBW according to the set gain value and generates a dimming signal Dim in response to the power saving mode signal PSM, a panel driver 140 that displays an image corresponding to the four-color data RGBW from the controller 130 on the liquid crystal panel 100, an inverter 150 that generates a lamp drive voltage VL in response to the dimming signal Dim from the controller 130, a backlight unit 160 that generates light in response to the lamp drive voltage VL from the inverter 150 and irradiates the generated light to the liquid crystal panel 100, and a voltage generator 170 that generates various voltages necessary for the driving of the mobile display device using the voltage charged in the battery 110.

The controller 130 in the mobile display device driving apparatus includes any one of the first to fourth embodiments of the data converter 134 shown in FIG. 4 and FIGS. 8 to 10.

The optical sensor 710 detects the amount of ambient light ABS of the mobile display device and supplies the detected ambient light amount ABS to the power saving mode signal generator 720.

The power saving mode signal generator 720 acts to compare the ambient light amount ABS from the optical sensor 710 with the level of a reference signal ref and generate the power saving mode signal PSM as a result of the comparison, when the mobile display device is set to the power saving mode by the user. At this time, the power saving mode signal PSM assumes a high state when the ambient light amount ABS is greater than or equal to about the level of the reference signal "ref" and a low state when the ambient light amount ABS is smaller than about the level of the reference signal "ref." Preferably, the level of the reference signal "ref" corresponds to a reference brightness set by the user.

A description will hereinafter be given of a mobile display device driving method using the mobile display device driving apparatus. First, the amount of ambient light ABS of the mobile display device is detected using the optical sensor 710 and the power saving mode signal PSM is set depending on the detected ambient light amount ABS.

When the ambient light amount ABS is greater than or equal to about the level of the reference signal "ref," three-color input data RGB is converted into four-color data RGBW using a gain value "Gain" set to the range of about 1 to 2 and a dimming signal Dim based on the white data W of the four-color data RGBW is generated. As a result, the liquid crystal panel 100 displays a color image by adjusting transmittance of light, irradiated from the backlight unit 160 depending on the dimming signal Dim, according to image signals Vdata based on the four-color data RGBW.

Conversely, when the ambient light amount ABS is smaller than about the level of the reference signal ref, three-color input data RGB is converted into four-color data RGBW using a maximum gain value "Gain" set to a rational number greater than or equal to about two and a dimming signal Dim set to reduce power consumption of the backlight unit 160 is generated. As a result, the liquid crystal panel 100 displays a color image using image signals Vdata based on the four-color data RGBW and light irradiated from the backlight unit 160 depending on the dimming signal Dim.

Therefore, the mobile display device driving apparatus and method can adjust the gain value Gain and dimming signal Dim based on the power saving mode signal PSM corresponding to the ambient light amount ABS to reduce power consumption of the backlight unit 160, so as to increase the usable time of the battery 110.

The mobile display device driving apparatus and method can be applied to mobile terminals including a mobile communication terminal, a personal communication service (PCS) terminal, a personal digital assistant (PDA), a smart phone and a next-generation mobile communication (IMT-2000) terminal, a notebook personal computer (PC), a navigation terminal, a portable game machine, or other mobile electronic device.

The mobile display device driving apparatus and method can set a gain based on a power saving mode signal corresponding to the remaining power of a battery or an ambient light amount, convert three-color data into four-color data using the set gain value and display the converted four-color data on a liquid crystal panel, and adjust a dimming signal according to the power saving mode signal to reduce power consumption of a backlight unit, so as to increase the usable time of the battery.

Further, the dimming value of the backlight unit is adjusted with white data of the four-color data, thereby making it possible to display a color image of the same brightness as that of a three-color sub-pixel structure.

Furthermore, since a black and white image is displayed only with a white sub-pixel, it is possible to further reduce the power consumption of the backlight unit, thus increasing the usable time of the battery still more.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An apparatus for driving a mobile display device, comprising:

a liquid crystal panel coupled with the mobile display device and including a plurality of liquid crystal cells each formed in sub-pixel areas of four colors;

an optical sensor coupled with the mobile display device and operable to detect an amount of ambient light;

a power saving mode signal generator coupled with the optical sensor and operable to generate a power saving mode signal based on the ambient light amount detected by the optical sensor to set a power saving mode of the liquid crystal panel;

a controller coupled with the power saving mode signal generator and operable to: set a gain value in response to the power saving mode signal; to convert external three-color input data into four-color data based on the set gain value; and to generate a dimming signal based on the power saving mode signal;

a panel driver coupled with the liquid crystal panel and operable to display an image based on the four-color data of the liquid crystal panel;

an inverter coupled with the controller and operable to generate a lamp drive voltage in response to the dimming signal; and a backlight unit coupled with the inverter and operable to generate light in response to the lamp drive voltage and irradiate the generated light to the liquid crystal panel;

wherein the power saving mode signal assumes a high state when the ambient light amount is greater than or equal to at a level of a reference signal and a low state when the ambient light amount is smaller than about the level of the reference signal;

wherein the controller comprises:

a driver control signal generator operable to generate control signals that control the panel driver using external input synchronous signals;

a data converter operable to set the gain value based on the power saving mode signal and to convert the external three-color input data into the four-color data based on the set gain value; and a dimming signal generator that generates the dimming signal using white data of the four-color data and the power saving mode signal.

2. The apparatus of claim 1, wherein the data converter comprises:

a gain value setter operable to set the gain value to a range of 1 to 2 when the power saving mode signal assumes the high state and to a rational number greater than or equal to two when the power saving mode signal assumes the low state;

a data amplifier operable to multiply each of the external three-color input data by the gain value to generate three-color amplified data;

a white data extractor operable to extract the white data from the three-color amplified data; and a subtracter operable to subtract the white data from each of the three-color amplified data to generate three-color data, wherein the four-color data includes the three-color data from the subtracter and the white data.

3. The apparatus of claim 1, wherein the data converter comprises:

a gain value setter operable to set the gain value to a range of 1 to 2 when the power saving mode signal assumes the high state and to a rational number greater than or equal to two when the power saving mode signal assumes the low state;

a first gamma corrector operable to gamma correct the three-color input data to generate linearized primary three-color data;

a brightness/color separator operable to separate the primary three-color data into a brightness component and color components;

a brightness amplifier operable to multiply the separated brightness component by the gain value to generate an amplified brightness component;

a mixer operable to mix the amplified brightness component and the separated color components to generate secondary three-color data; and a second gamma corrector operable to gamma correct the secondary three-color data to generate three-color data and to gamma correct the amplified brightness component to generate the white data, wherein the four-color data includes the three-color data and the white data.

4. The apparatus of claim 1, wherein the data converter comprises:

a gain value setter operable to set the gain value to a range of 1 to 2 when the power saving mode signal assumes the high state and to a rational number greater than or equal to two when the power saving mode signal assumes the low state;

a data amplifier operable to multiply each of the external three-color input data by the gain value to generate three-color amplified data;

a white data extractor operable to extract the white data from the three-color amplified data;

a subtracter operable to subtract the white data from each of the three-color amplified data to generate three-color data; and a selector operable to selectively output the three-color data based on the power saving mode signal, wherein the four-color data includes the three-color data from the subtracter and the white data.

5. The apparatus of claim 4, wherein the selector supplies the three-color data to the panel driver when the power saving mode signal assumes the high state and does not supply the three-color data to the panel driver when the power saving mode signal assumes the low state.

6. The apparatus of claim 5, wherein a black and white image based on the white data is displayed on the liquid crystal panel when the liquid crystal panel is in a power saving mode related to the power saving mode signal of the low state.

7. The apparatus of claim 1, wherein the data converter comprises:

a gain value setter operable to set the gain value to a range of 1 to 2 when the power saving mode signal assumes the high state and to a rational number greater than or equal to two when the power saving mode signal assumes the low state;

a first gamma corrector operable to gamma correct the three-color input data to generate linearized primary three-color data;

a brightness/color separator operable to separate the primary three-color data into a brightness component and color components;

a brightness amplifier operable to multiply the separated brightness component by the gain value to generate an amplified brightness component;

a mixer operable to mix the amplified brightness component and the separated color components to generate secondary three-color data;

a selector operable to selectively output the secondary three-color data in response to the power saving mode signal; and a second gamma corrector operable to gamma correct the secondary three-color data from the selector to generate three-color data and to gamma correct the amplified brightness component to generate the white data, wherein the four-color data includes the three-color data and the white data.

8. The apparatus of claim 7, wherein the selector supplies the three-color data to the second gamma corrector when the power saving mode signal assumes the high state and does not supply the three-color data to the second gamma corrector when the power saving mode signal assumes the low state.

9. The apparatus of claim 8, wherein a black and white image based on the white data is displayed on the liquid crystal panel when the liquid crystal panel is in the power saving mode corresponding to the power saving mode signal of the low state.

10. The apparatus of claim 1, wherein the dimming signal generator comprises:

a dimming value extractor operable to extract a first dimming value signal based on the white data from a set dimming curve;

a second dimming value signal fixed or arbitrarily set by a user to reduce power consumption of the backlight unit; and a selector operable to select the first dimming value signal as the dimming signal and to supply the selected first dimming value signal to the inverter, when the power saving mode signal assumes the high state, and operable to select the second dimming value signal as the dimming signal and supply the selected second dimming value signal to the inverter, when the power saving mode signal assumes the low state.

11. The apparatus of claim 10, wherein the dimming curve has any one of a linear curve shape, a quadratic curve shape or a diagonal shape set between a minimum dimming value and a maximum dimming value.

12. A method of driving a mobile display device, the display device including a liquid crystal panel including a plurality of liquid crystal cells each formed in sub-pixel areas of four colors, the method comprising:

detecting an amount of ambient light and generating a power saving mode signal based on the detected ambient light amount to set a power saving mode of the liquid crystal panel;

setting a gain value based on the power saving mode signal, converting external three-color input data into four-color data based on the set gain value and generating a dimming signal based on the power saving mode signal;

driving a backlight unit based on a lamp drive voltage corresponding to the dimming signal to irradiate light to the liquid crystal panel; and supplying image signals based on the four-color data to the liquid crystal panel to display a corresponding image on the liquid crystal panel;

wherein detecting the amount of ambient light comprises setting the power saving mode signal to a high state when the ambient light amount is greater than or equal to a level of a reference signal and setting the power saving mode signal to a low state when the ambient light amount is smaller than the level of the reference signal;

wherein setting the gain value comprises:

generating control signals that control a panel driver using external input synchronous signals;

setting the gain value based on the power saving mode signal and converting the external three-color input data into the four-color data based on the set gain value; and generating the dimming signal using white data of the four-color data and the power saving mode signal.

13. The method of claim 12, wherein converting the external three-color input data into the four-color data comprises:

setting the gain value to a range of 1 to 2 when the power saving mode signal assumes the high state and to a rational number greater than or equal to two when the power saving mode signal assumes the low state;

multiplying each of the external three-color input data by the gain value to generate three-color amplified data;

extracting the white data from the three-color amplified data; and subtracting the white data from each of the three-color amplified data to generate three-color data, wherein the four-color data includes the three-color data and the white data.

14. The method of claim 12, wherein converting the external three-color input data into the four-color data comprises:

setting the gain value to a range of 1 to 2 when the power saving mode signal assumes the high state and to a rational number greater than or equal to about two when the power saving mode signal assumes the low state;

gamma correcting the three-color input data to generate linearized primary three-color data;

separating the primary three-color data into a brightness component and color components;

multiplying the separated brightness component by the gain value to generate an amplified brightness component;

mixing the amplified brightness component and the separated color components to generate secondary three-color data; and gamma correcting the secondary three-color data to generate three-color data and gamma correcting the amplified brightness component to generate the white data, wherein the four-color data includes the three-color data and the white data.

15. The method of claim 12, wherein converting the external three-color input data into the four-color data comprises:

setting the gain value to a range of 1 to 2 when the power saving mode signal assumes the high state and to a rational number greater than or equal to two when the power saving mode signal assumes the low state;

multiplying each of the external three-color input data by the gain value to generate three-color amplified data;

extracting the white data from the three-color amplified data;

subtracting the white data from each of the three-color amplified data to generate three-color data; and selectively outputting the three-color data in response to the power saving mode signal using a selector, wherein the four-color data includes the three-color data and the white data.

16. The method of claim 15, further comprising outputting, by the selector, the three-color data when the power saving mode signal assumes the high state and not outputting the three-color data when the power saving mode signal assumes the low state.

17. The method of claim 16, further comprising displaying a black and white image based on the white data on the liquid crystal panel when the liquid crystal panel is in the power saving mode corresponding to the power saving mode signal of the low state.

18. The method of claim 12, wherein converting the external three-color input data into the four-color data comprises:

setting the gain value to a range of 1 to 2 when the power saving mode signal assumes the high state and to a rational number greater than or equal to two when the power saving mode signal assumes the low state;

gamma correcting the three-color input data using a first gamma corrector to generate linearized primary three-color data;

separating the primary three-color data into a brightness component and color components;

multiplying the separated brightness component by the gain value to generate an amplified brightness component;

mixing the amplified brightness component and the separated color components to generate secondary three-color data;

selectively outputting the secondary three-color data in response to the power saving mode signal using a selector; and gamma correcting the secondary three-color data from the selector using a second gamma corrector to generate three-color data and gamma correcting the amplified brightness component using the second gamma corrector to generate the white data, wherein the four-color data includes the three-color data and the white data.

19. The method of claim 18, further comprising supplying, by the selector, the three-color data to the second gamma corrector when the power saving mode signal assumes the high state and not supplying the three-color data to the second gamma corrector when the power saving mode signal assumes the low state.

20. The method of claim 19, further comprising displaying a black and white image based on the white data on the liquid crystal panel when the liquid crystal panel is in the power saving mode corresponding to the power saving mode signal of the low state.

21. The method of claim 12, wherein generating the dimming signal comprises:

extracting a first dimming value corresponding to the white data from a set dimming curve;

supplying a second dimming value fixed or arbitrarily set by a user to reduce power consumption of the backlight unit; and outputting the first dimming value as the dimming signal when the power saving mode signal assumes the high state and the second dimming value as the dimming signal when the power saving mode signal assumes the low state.

22. The method according to claim 21, wherein the dimming curve comprises any one of a linear curve shape, a quadratic curve shape or a diagonal shape set between a minimum dimming value and a maximum dimming value.

* * * * *

UNITED STATES PATENT AND TRADEMARK OFFICE

CERTIFICATE OF CORRECTION

PATENT NO. : 8,427,468 B2
APPLICATION NO. : 13/450069
DATED : April 23, 2013
INVENTOR(S) : Hee Jung Hong et al.

It is certified that error appears in the above-identified patent and that said Letters Patent is hereby corrected as shown below:

In the Claims

In column 12, claim 1, line 57, before "a level of a reference" delete "at".

In column 12, claim 1, line 58, after "is smaller than" delete "about".

In column 15, claim 14, line 49, after "than or equal to" delete "about".

Signed and Sealed this
Ninth Day of July, 2013

Teresa Stanek Rea
*Acting Director of the United States Patent and Trademark Office*